US005733108A

United States Patent [19]

Riffe

[11] Patent Number: 5,733,108

[45] Date of Patent: Mar. 31, 1998

[54] HERMETIC REFRIGERATION COMPRESSOR

[75] Inventor: Delmar Ray Riffe, Beaver, W. Va.

[73] Assignee: White Consolidated Industries, Inc., Cleveland, Ohio

[21] Appl. No.: 654,230

[22] Filed: May 28, 1996

[51] Int. Cl.[6] ..... F04B 11/00; F04B 39/10

[52] U.S. Cl. ..... 417/542; 417/571

[58] Field of Search ..... 417/542, 571

[56] References Cited

U.S. PATENT DOCUMENTS

| | | | |
|---|---|---|---|
| 2,043,849 | 6/1936 | Bixler | 417/571 |
| 3,509,907 | 5/1970 | Gannaway | 417/571 |
| 4,988,269 | 1/1991 | Blass | 417/542 |
| 5,147,189 | 9/1992 | Barnowski | 417/571 |
| 5,302,087 | 4/1994 | Pacht | 417/571 |
| 5,346,373 | 9/1994 | Riffe | 417/415 |
| 5,362,216 | 11/1994 | Hammelmann | 417/571 |

*Primary Examiner*—Bibhu Mohanty
*Attorney, Agent, or Firm*—Pearne, Gordon, McCoy & Granger LLP

[57] ABSTRACT

A hermetic refrigeration compressor has a tubular casing closed at each end by suitable caps and in which a cylinder block and motor stator are held by a press-fit. The cylinder block carries a crankshaft that is centrally located by a pair of axially-spaced bearings and defining a central space within which is mounted a connecting rod and piston. The piston has two portions, one on either side of the crankshaft, connected together by a pair of arms that extend around the crankshaft. One end of the piston slides within a pumping cylinder, while the other end of the piston to which the connecting rod is connected through a wrist pin, slides in a guide bore. This arrangement gives a slow reversal at the end of the compression stroke and a fast reversal at the end of the suction stroke. A segmental-shaped cylinder head is fitted to match a planar face on the cylinder block at the end of the pumping cylinder. The cylinder head has a central discharge valve and opening, and an annular suction space connected to the pumping cylinder by a plurality of suction ports. The suction and discharge lines are connected directly to the casing and have external mufflers to reduce sound propagation.

26 Claims, 7 Drawing Sheets

HERMETIC REFRIGERATION COMPRESSOR

BACKGROUND OF THE INVENTION

This invention relates generally to hermetic refrigeration compressors and more particularly to small single cylinder reciprocating piston hermetic compressors particularly adapted for use in household refrigerators and freezers.

The earliest compressors used for household refrigerators were of the open type using an electric motor connected by a drive belt to a piston compressor having a separate cylinder block and crankcase. Such compressors tended to be quite large and noisy as well as subject to problems of leakage of the refrigerant. The next improvement was the hermetic compressor in which the electric motor and compressor were sealed within a steel shell and all of the refrigerant connections could then be brazed or welded joints. These compressors were first made by attaching the electric motor directly to the compressor crankcase and then fitting the shell over the assembly with a rigid connection. This still resulted in a great deal of noise and vibration and required that the unit be supported on resilient external mounts.

The next stage was the use of internal resilient mounts by supporting the motor and compressor on springs within the outer shell. The space within the shell was at low side or suction pressure to avoid having the high discharge pressure acting on the shell and against the back side of the pumping piston. Because of the relative movement between the compressor unit and the shell, it is necessary to use some type of flexible connection, such as a long convoluted piece of tubing to connect the discharge port with the exterior of the shell.

Until recently, improvements to these compressors were directed to reducing noise and vibration as well as cost of manufacture and relatively little effort was directed to matters of energy efficiency. For example, it was common practice to circulate the returning refrigerant on the suction side throughout the compressor shell for cooling purposes even though this resulted in considerable heating of the suction gases and loss of volumetric efficiency. Furthermore, the need for a long path for the discharge line inside the shell to allow flexibility of the line resulted in further heating of the compressor and the returning refrigerant gas. For these reasons, it has been recognized that the internal spring mount for compressors has a definite adverse effect on overall compressor energy efficiency.

Another problem with compressor efficiency arises from the geometry of the standard crankpin and connecting rod arrangement. The motion of the piston departs from simple harmonic motion because of this geometry and the departure is increased as the ratio between the piston stroke and the connecting rod length decreases. Hermetic refrigeration compressors tend to use relatively short connecting rods both to reduce the overall dimensions of the unit as well as because of the need to reduce the amount of reciprocating mass when the unit rotates at high speed. The motors for greatest electrical efficiency are almost always of the two pole type with an operating speed at 60 HZ of about 3450 rpm, and at these speeds, while it is also desirable to have a relatively large cylinder bore and a short stroke, the departure from simple harmonic motion decreases the efficiency of the compressor. In the case of the standard crank and connecting rod, the effect of shortening the length of the connecting rod is to increase the deviation from harmonic motion by increasing the piston speed near top center and decreasing the speed near bottom center.

The reason that this motion is undesirable arises from the use of a pressure operated valve for the discharge valve. The valve must open against the high pressure in the discharge line, and therefore cannot open until the pressure within the cylinder exceeds that in the discharge line. This means that in a typical system in a household refrigerator, the discharge pressure will be about ten times the suction pressure under which the cylinder is filled through the suction valve. Thus the piston must move through 90% of its stroke before the discharge valve can open. In the case of simple harmonic motion, this point occurs about 37.5 degrees of crankshaft rotation before top center, while with the usual ratio between piston stroke and connecting rod length this point occurs several degrees later. Since the discharge valve must necessarily close shortly after top center when the cylinder pressure drops below that in the discharge line, later opening and earlier closing of the valve caused by the deviation from true harmonic motion reduces gas flow and decreases efficiency.

SUMMARY OF THE INVENTION

The present invention provides a novel single cylinder hermetic refrigeration compressor particularly adapted for use in household refrigerators and freezers, but also useful for small room air conditioners and dehumidifiers.

According to one aspect of the invention, advantage is taken of the distortion of simple harmonic motion caused by the use of a short connecting rod by inverting the connecting rod and wrist pin with respect to the piston head so that the wrist pin is at the opposite end of the piston from the piston head and valve plate. The piston is formed with an open central section through which the crankshaft passes and in which the crank end of the wrist pin is located. In order to keep friction forces sufficiently small yet properly guide the piston in the cylinder bore, the opposite end of the piston is formed with a tubular skirt portion which slides within a guide cylinder portion of the cylinder block coaxial with the pumping cylinder but on the opposite side of the crankshaft. This guide cylinder has the same bore diameter as the main cylinder adjacent the valve plate, but is cut away along the sides to form a slot which receives the harp or bowed section which surrounds the crankshaft and connects the head and skirt portions of the piston as a unitary piece.

Another feature of the invention is the assembly of the cylinder block, motor and case. The case has a cylindrical main section, and the cylinder block and motor have cylindrical exteriors and are pressed into opposite ends of the case which holds them in axial alignment, after which the end caps are secured in place. The cylinder block exterior has the form of a complete cylinder except for a segment which is cut away and in which is located the combined valve plate and cylinder head which is directly connected to the external suction and discharge mufflers through the wall of the case. The flat segment face extends perpendicular to the axis of the pumping cylinder and is smooth except for projecting locating pins to align the valve plate. The valve plate forms part of the cylinder head and together with the cylindrical outer casing, it encloses both the suction and discharge plenum chambers.

This arrangement allows both the suction and discharge lines to be connected directly to the two plenum chambers and pass directly through the casing from the exterior. The discharge port can then be located at the most efficient position at the center of the cylinder bore. The discharge valve is a poppet of the type disclosed in the present inventor's U.S. Pat. No. 5,346,373, and can be biased by a folded leaf spring positioned in line with the discharge line, which extends out through the casing in line with the axis of the pumping cylinder. This also allows the suction plenum to surround the discharge port and provide a number of suction ports extending through the valve plate in a circle around the discharge port.

The suction valve is formed from a thin sheet of spring steel, as is typical for small compressors, in the form of an annular disk secured to the rest of the sheet at only one point, with the center having an opening slightly larger than the discharge port with which it is aligned. The number of suction ports, which may be six to ten in number, together with the annular shape of the suction plenum which gives a large volume, provides very high volumetric efficiency.

Both the suction and discharge mufflers are located immediately outside the casing and this allows them to be sized for maximum efficiency. Furthermore, by placing the discharge muffler outside the casing, there is no heat conduction to the incoming suction gases or the compressor structure.

DETAILED DESCRIPTION OF THE PREFERRED EMBODIMENTS

Figure 1:
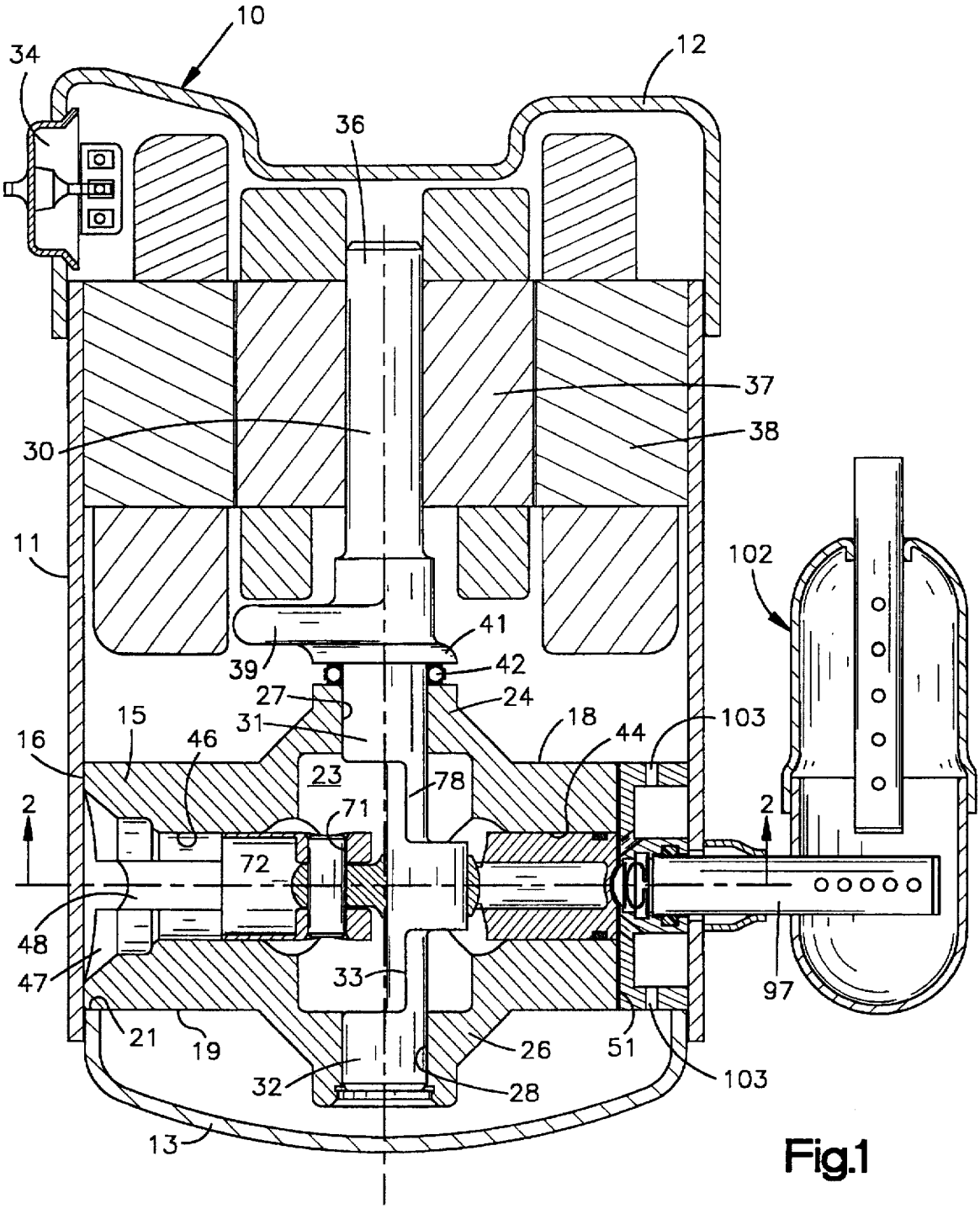
FIG. 1 is an elevational cross-sectional view of a refrigeration compressor incorporating a preferred embodiment of the present invention.
Figure 2:
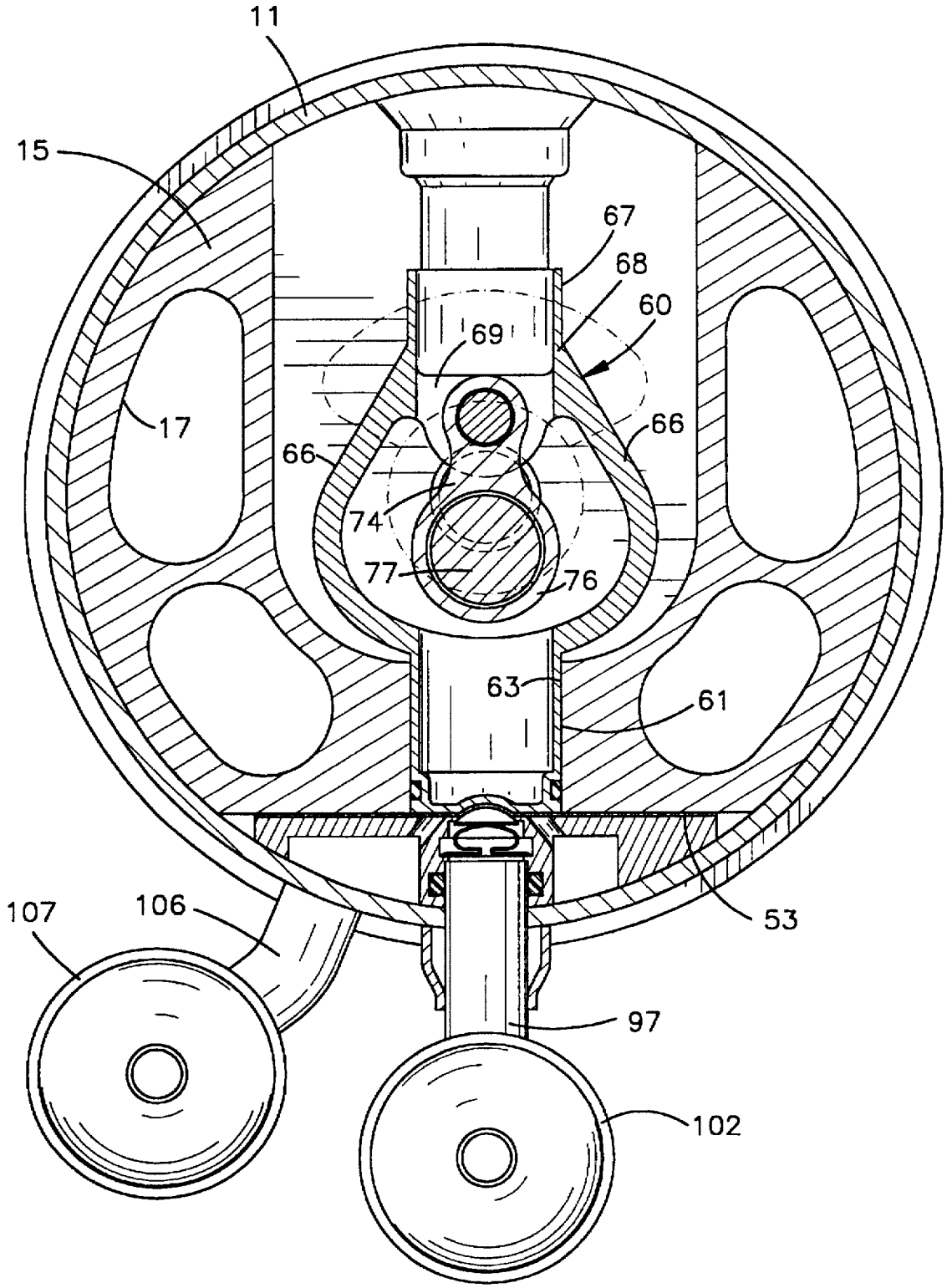
FIG. 2 is a cross-sectional view of the compressor on line 2—2 of FIG. 1 showing the piston at top center.
Figure 3:
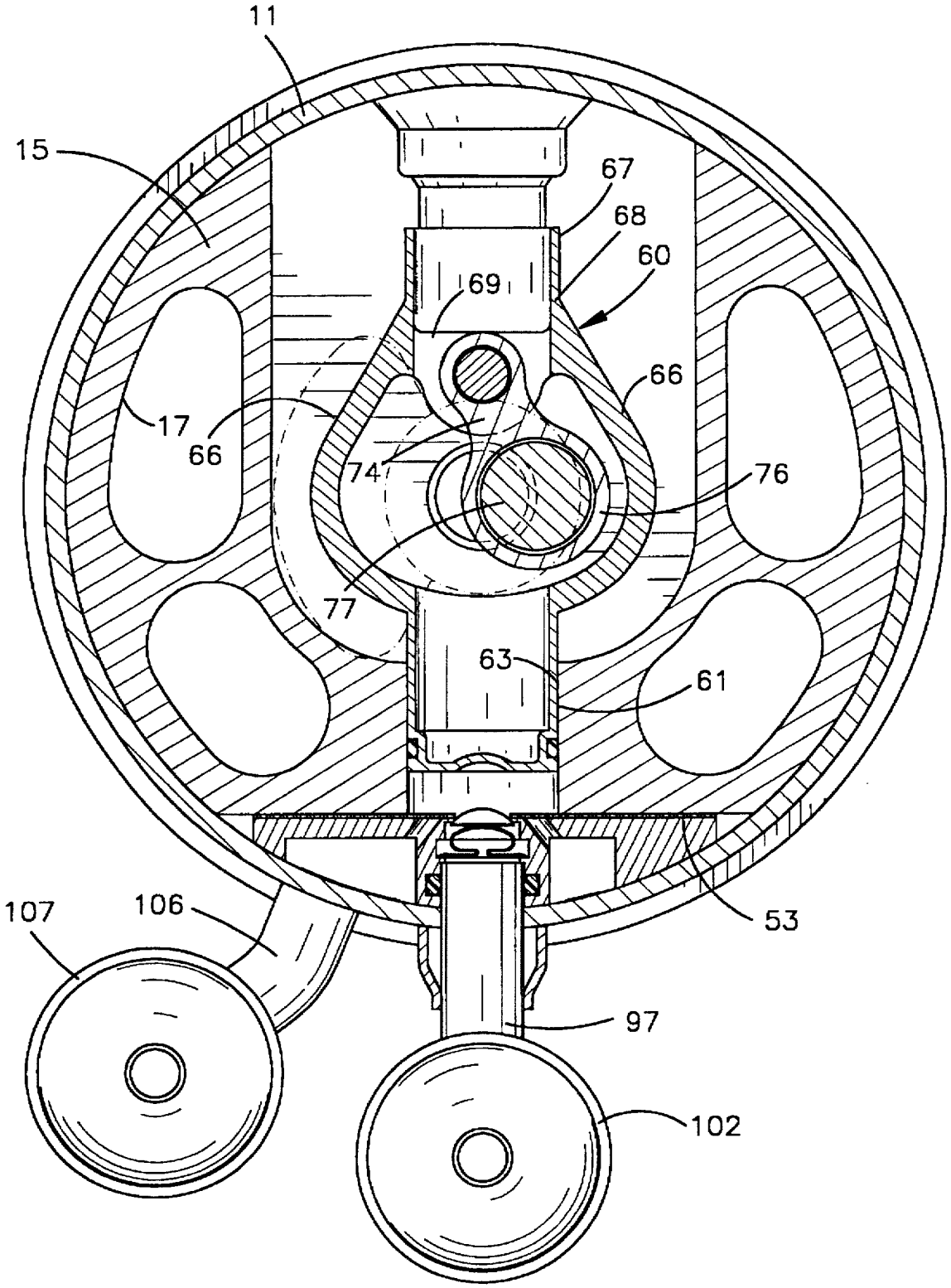
FIG. 3 is a cross-sectional view similar to FIG. 2, but showing the piston 90° off top center.
Figure 4:
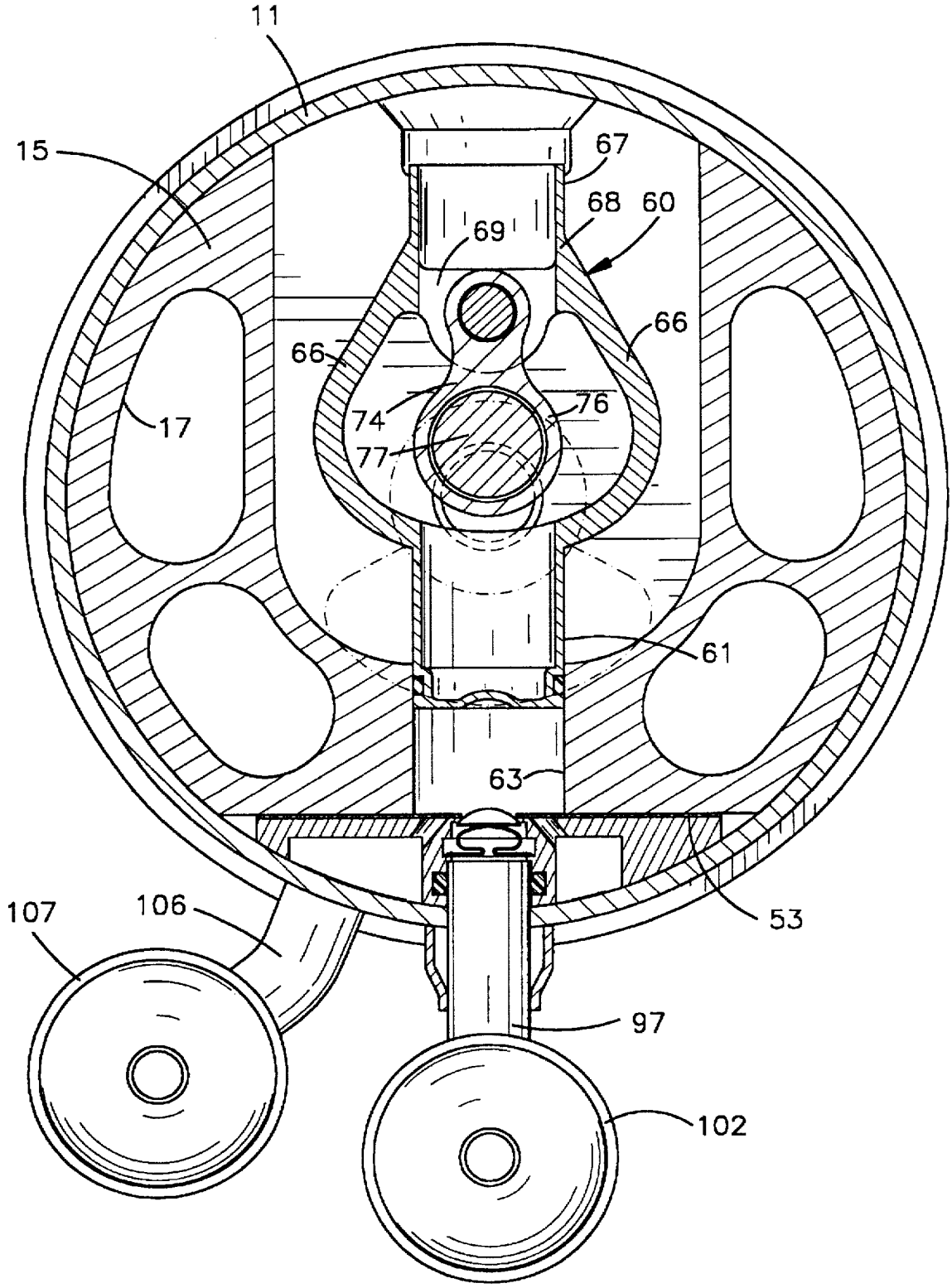
FIG. 4 is a cross-sectional view similar to FIGS. 2 and 3, but showing the piston at bottom center.
Figure 5:
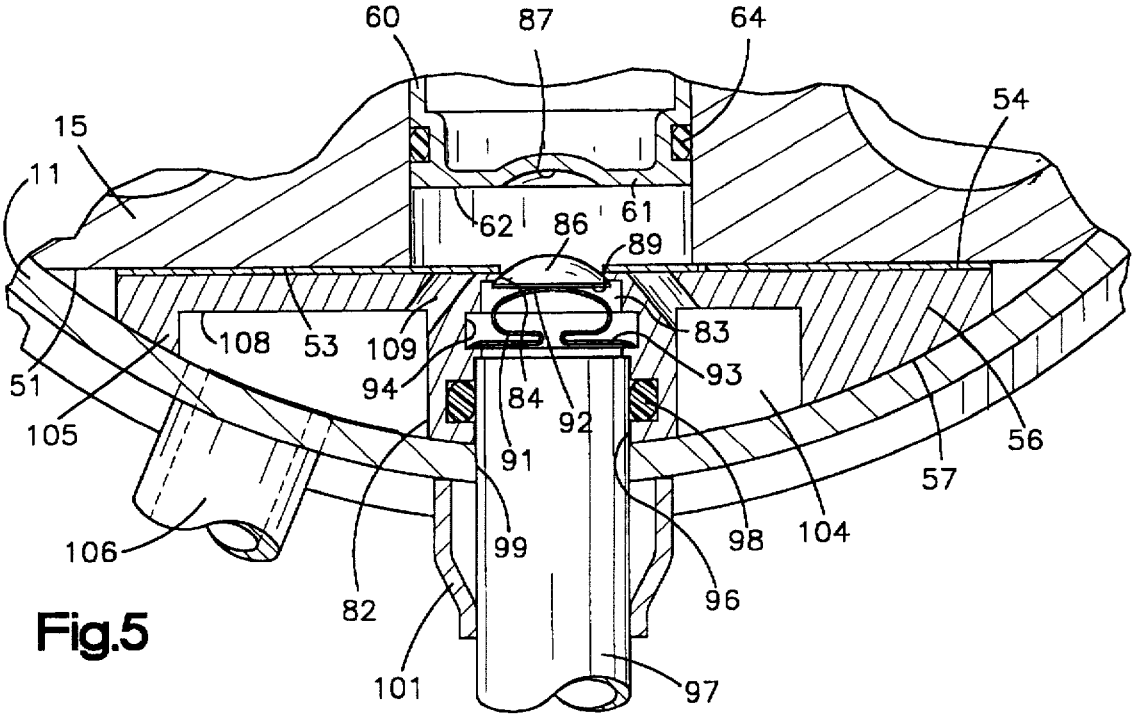
FIG. 5 is a fragmentary cross-sectional view of the discharge valve and cylinder head showing the piston in the position of FIG. 3 and the valve closed.
Figure 6:
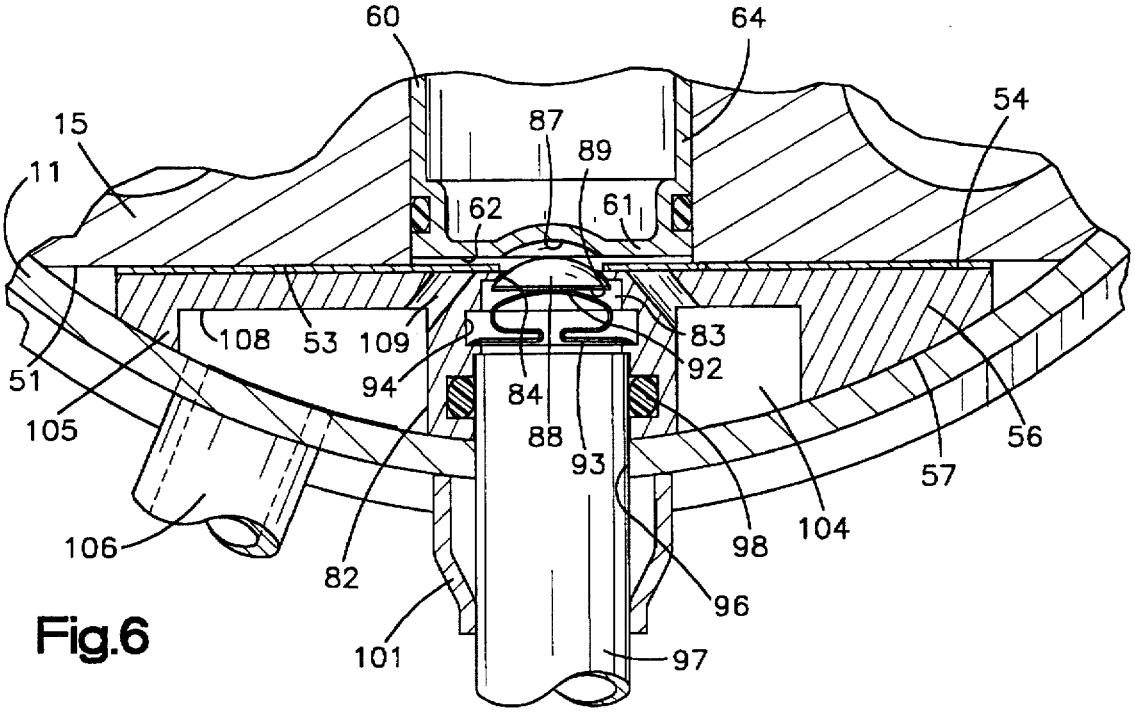
FIG. 6 is a fragmentary cross-sectional view similar to FIG. 5, but showing the piston at top center and the valve open.

Referring now to the drawings in greater detail and, in particular, to FIG. 1, the compressor is mounted within a casing 10, which is formed in three parts, including a cylindrical middle portion 11, which is closed-off at the upper end by an upper cap 12, which fits telescopingly over the outside of the middle portion 11 and is welded thereto at final assembly. Likewise, the lower end of the cylindrical middle portion 11 is closed-off by a lower cap 13, which fits telescopingly within the middle portion 11, and likewise, is welded in place after assembly is completed. The casing may be provided with suitable flanges or studs for mounting, but these are not shown since they form no part of the present invention.

A disc-shaped cylinder block 15 having a cylindrical outer periphery 16 is fitted within the middle casing portion 11 by a press-fit to prevent movement and to tightly secure it in place. The cylinder block 15 includes upper and lower parallel faces 18 and 19, and, to reduce weight and allow communication and pressure balance between the chambers above and below the cylinder block, openings or passages 17 extend through the cylinder block between the faces. It will be seen that the cylinder block 15 is positioned within the middle portion 11 with the lower face 19 adjacent the upper edge 21 of the lower cap 13.

The cylinder block 15 has a central chamber 23 which is closed-off at its upper end by a projecting central upper boss 24, and at its lower end by a projecting lower boss 26. These bosses have upper and lower bearing bores 27 and 28 extending therethrough in alignment with each other. A crankshaft 30 has upper and lower bearing portions 31 and 32 spaced apart by an intermediate portion 33, and these bearing portions extend within the bearing bores 27 and 28 to journal the crankshaft 30 within the cylinder block 15.

The crankshaft 30 has an upper end 36 projecting above the cylinder block, and a rotor 37 of a suitable induction motor is secured thereon to rotate within the motor stator 38, which is also preferably press-fitted within the upper end of the casing middle portion 11. It should be understood that the rotor 37 and stator 38 form the usual type of motor for a hermetic compressor, as is well-known in the art, and the motor is connected to an external power source through a connector 34 of the usual type used for hermetic compressors. The crankshaft 30 also may be provided with a projecting counterweight 39 below the rotor 37, and this may be part of a radially-extending flange 41 which engages a suitable thrust bearing 42 to transfer the weight of the crankshaft and the rotor through the thrust bearing 42 to the face of the upper boss 24.

At the central chamber 23 of cylinder block 15, midway between the upper and lower bosses 24 and 26, there is located a radially-extending cylinder bore 44, which extends outwardly to an end face 51 which is cut straight across the cylinder block perpendicular to the axis of cylinder bore 44 to define a segmental shaped space between the end face 51 and the inner surface of casing middle portion 11. Directly across from the axis of crankshaft 30, the cylinder block is provided with a guide bore 46 which is coaxial with cylinder bore 44 to have a diameter preferably slightly greater than that of the cylinder bore 44. Guide bore 46 flares outwardly at the outer end 47 and has a clearance slot 48 formed in the cylinder block along the sides.

A segment-shaped cylinder head 56 is positioned within the space formed by the end face 51 and has an outer periphery 57 adapted to make a tight fit with the casing portion 11. Cylinder head 56 has a valve face 54 which abuts against a valve sheet 53 formed of thin spring material for the suction valve, and the sheet 53 may be spaced from the end face 51 by a suitable gasket (not shown), which may be used in various thicknesses for tolerance purposes, to adjust the spacing between the piston face and the valve sheet, as is well-known in the art.

The piston 60 is formed as a unitary assembly and has a hollow head portion 61 extending within the cylinder bore 44. Head portion 61 has an end face 62 which, at the end of the compression stroke, is adjacent the valve sheet 53. A piston skirt 63 extends backward from the face 62 and may carry a suitable piston ring 64 to ensure proper compression and sealing between the piston and the cylinder bore. Rearward of skirt 63 is a yoke or harp portion 66, comprising two leg portions which flare outward and extend back to a cylindrical guide portion 67 which makes a sliding fit within the guide bore 46. The legs of yoke portion 66 flare outward in such a manner as to allow clearance for the connecting rod and crank portion and serve to rigidly connect the head portion 61 and the guide portion 67 together as a unit. The guide portion 67 includes a skirt portion 68 which makes sliding contact with the guide bore 46 and a pair of bosses 69 through which are provided with a transverse bore 71 parallel to the axis of the crankshaft to receive a wrist pin 72. A connecting rod 74 is journalled at its small end on the wrist pin 72 and has a big end 76 which is journalled on an eccentric crank 77 on the crankshaft intermediate portion 33. The crank 77 is connected to the bearing portions 31 and 32 by a pair of cheek portions 78, and for assembly purposes which will be explained later, it should be noted that each of the cheek portions 78 has a length along the axis of the crankshaft 30 greater than the length of each of the upper and lower bearing bores 27 and 28, and the bosses on the cylinder block.

It will be seen that by placing the wrist pin 72 on the opposite side of the crankshaft from the piston head 61, the positions of the slow and fast reversals that result from crank geometry are reversed, with the slow reversal now taking place at top dead center of the head portion, while the fast reversal now takes place at bottom dead center. Since the wrist pin is positioned so far from the head portion 61, the guide portion 67 is necessary to take the side thrust on the piston and minimize any rocking or misalignment of the piston assembly which would increase friction and thereby reduce the efficiency of the compressor. The guide portion must be equal to or slightly larger in diameter than the head portion 61, since the entire piston assembly must be inserted through the outer end 47 of the guide bore 56, and the clearance slots 48 on either side allow clearance space to prevent rubbing of the yoke or harp 66. Preferably, the guide bore 46 and guide portion 67 are slightly larger in diameter than the cylinder bore 44 and head portion 61 to provide a smooth, close fit while allowing easy assembly.

Figure 7:
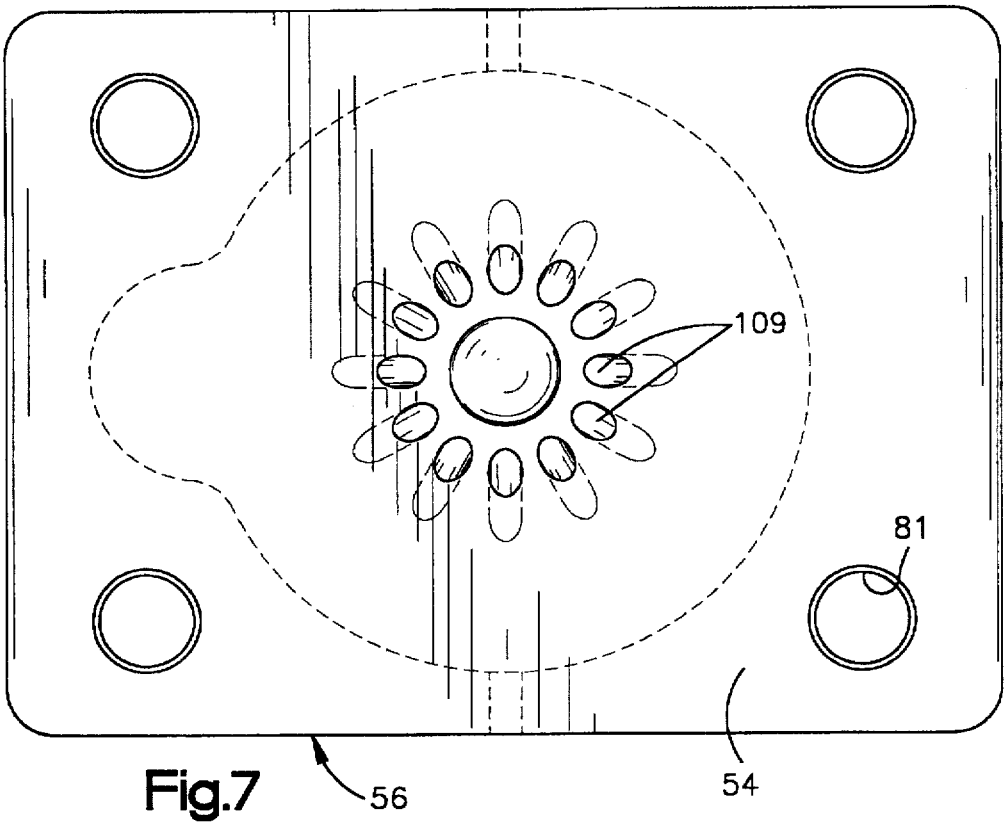
FIG. 7 is a fragmentary elevational view of the combined cylinder head and valve plate as seen from the piston side.
Figure 8:
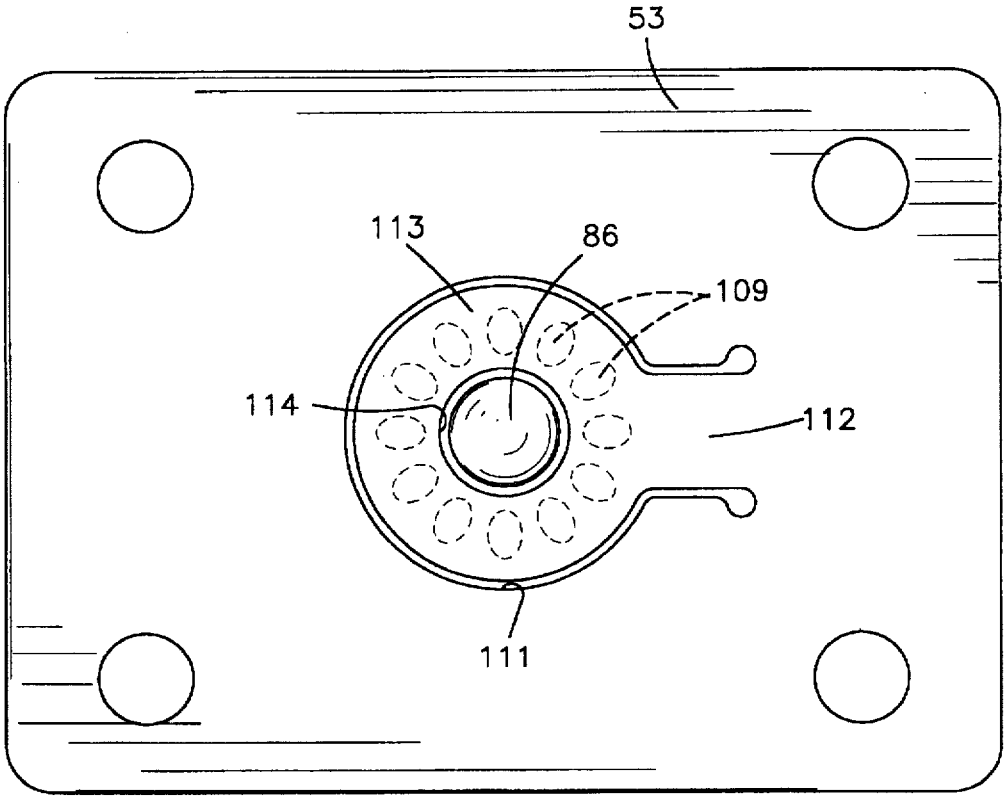
FIG. 8 is a view of the section valve plate.

The cylinder head 56 is accurately positioned on the cylinder block 15 by the use of suitable dowel pins (not shown) which are mounted on the cylinder block and extend into openings 81 on the cylinder head, as shown in FIGS. 7 and 8. The cylinder head 56 also has a central boss portion 82 in which is located the discharge port 83 having a valve seat 84 around the port adjacent the valve face 54. A poppet 86, which may be constructed in accordance with the teachings of the present inventor's U.S. Pat. No. 5,346,373, granted Sep. 13, 1994, is positioned within the port 83. The poppet has a semi-spherical sealing face 88 which makes surface abutting sealing engagement with the semi-spherical surface of the valve seat 84. Since the poppet extends beyond the cylinder head valve face 54, the piston face 62 is formed with a recess 87 to allow the poppet to project into the space while minimizing the re-expansion volume present when the piston is at top dead center. Opposite the sealing face 88, poppet has a flat rear face 89 which engages a valve spring 91. In the present embodiment, this spring is in the form of a bow or omega shape with a bight 92 pressing against the center of the face 89 and curving around back into a pair of projecting ends 93 which fit within an annular groove 94 in the boss 82. Outwardly of groove 94 is a bore 96 which receives a discharge line 97. An O-ring 98 may be used to provide sealing, and the discharge line extends outward through an opening 99 in the middle casing portion 11 where it extends through a collar 101 to an external discharge muffler 102 of any suitable construction. The collar 101 is welded to both the discharge line 97 and the housing 11 for reinforcing and sealing purposes. This construction allows the use of a relatively large diameter discharge line 97 which also serves as a portion of the discharge space and does not require any other provision for any plenum chamber downstream of the poppet 86.

The cylinder head 56 is formed with a suction space 104 which extends around the central boss 82 and is closed off by a peripheral wall 105 which extends into sealing contact with the middle casing portion 11. Since it is desired to have the space within the casing 10 at low suction pressure, balancing ports 103 extend through the peripheral wall 105 to connect with the interior space and ensure that any high-pressure gasses that leak past the piston head 61 into the interior are allowed to flow through ports 103 back into the suction space to ensure that the casing is not pressurized. A suction line 106 extends from the external suction muffler 107 through the wall 11 to connect to the suction space 104. By having both of the mufflers 102 and 107 outside of the casing 10, it is possible to reduce the size and weight of the compressor while providing almost unlimited space so that the mufflers 102 and 107 may be designed to maximize the fluid flow efficiency and noise reduction to the desired extent.

The suction space 104 includes a flat, annular wall portion 108 extending generally parallel to the cylinder head face 54, and this wall is continuous around the central boss 82. A plurality of suction ports 109, which may be twelve in number as shown in the drawings, or fewer as required, slant diagonally through the cylinder head from the junction of the wall 108 and central boss 82 inward to a point closer to the discharge port 83, but spaced away therefrom to allow space for the valve seat for sealing of the suction valve against the face 54. These suction ports 109 may be reduced in number and size for smaller displacement compressors, but are intended to provide a minimum of restriction to ensure maximum filling of the cylinder on the suction stroke. The suction valve reed is formed in the thin valve sheet 53 by a slot 111 formed therein to be mostly circular with short, parallel portions that define a neck 112 which accommodates all the flexing of the suction valve when it opens and closes. Thus, the valve has an annular head 113 defined by the slot 111, and the head is adapted to seal all of the suction ports 109. In the center of the head 113 is a circular opening 114 slightly greater than the diameter of the discharge port 83 to allow free flow of the discharge gasses through the opening 114 on the compression stroke of the piston. It will be seen that the arrangement of the discharge port 83 and suction ports 109 allow maximum fluid flow with a minimum of restriction as often found in much larger compressors, while retaining the simple valve structure for the suction and discharge valves that provide the high reliability and long life of small refrigeration compressors.

Figure 9:
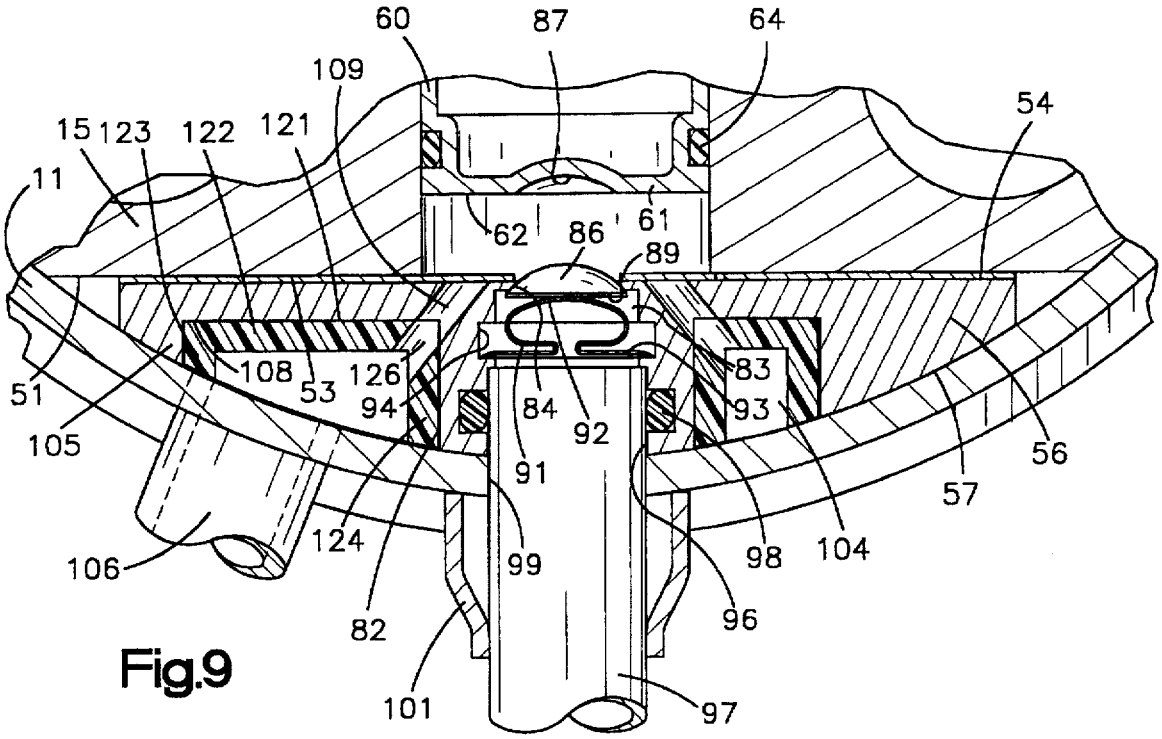
FIG. 9 is a fragmentary cross-sectional view similar to FIG. 5, but showing an alternative embodiment of the invention.
Figure 10:
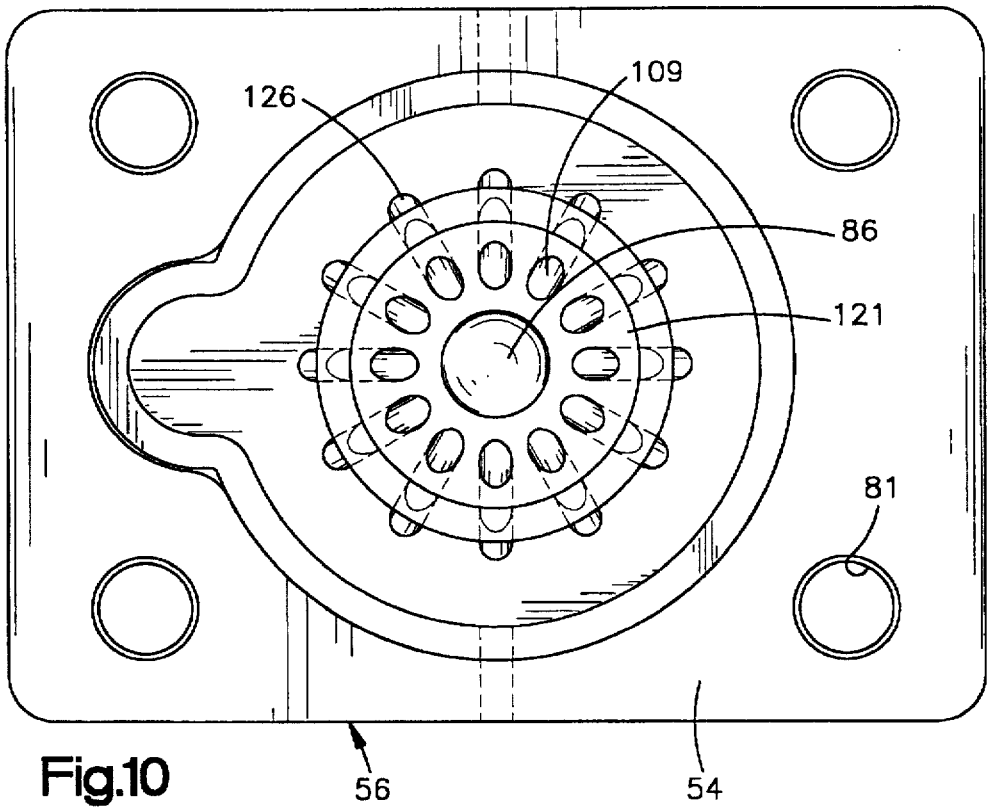
FIG. 10 is an elevational view of the cylinder head and valve plate of the embodiment of FIG. 9.

With the cylinder head arrangement described above, there will be little heating of the suction space 104 by the hot discharge gasses, since they pass immediately into the discharge line 97, which tends to get rather hot, and there can be some conduction to the suction space 104. To further minimize the heating of the incoming suction gasses, an alternative arrangement is shown in FIGS. 9 and 10 that provides a liner 121 made from a plastic insulating material having low thermal conductivity which fits within the existing suction space 104 to further insulate the incoming suction gasses from any heat within the cylinder head 56. The liner 121 has a flat wall 122 which abuts against the wall 108 and an outer wall 123 which extends around the peripheral wall 105. Likewise, the inner wall 124 extends along the outer surface of central boss 82. Suitable port openings 126 are provided in liner 121 at the junction of the flat wall 122 and inner wall 124 to align with the suction ports 109 to ensure a minimum of restriction of gas flow therethrough.

This compressor arrangement allows for easy assembly when performed in the proper sequence. Before the two caps 12 and 13 are assembled in place, the piston 60 must be preassembled with the wrist pins 72 and connecting rods 74 and then inserted into the cylinder bore 44 and guide bore 46. The cylinder head 56, with the suction and discharge valves, is then positioned on the cylinder block 15, and this assembly is then pressed in place in the lower end of the middle casing portion 11. The rotor 37 is preferably pressed onto the crankshaft 30 at this point, and the assembly inserted with the thrust bearing 42 into the upper end of the casing. Because of the spacing of the cheek portions 78 on crankshaft 30, it is possible to pass the lower bearing portion 32 through the upper bearing bore 27, and then through the connecting rod big end 76, at which point by rotating parts slightly out of center, it is then possible to align the crank 77 with the big end 76, since the connecting rod 74 can move around the wrist pin 72, at which point the lower bearing portion 32 can enter the lower bearing bore 28 while the upper bearing portion 31 enters the upper bearing 27, and the thrust bearing 42 engages the upper boss 24. After these parts are assembled together, it is now possible to press the stator 38 into the upper end of the casing 11, after which the end caps 12 and 13 can be assembled and welded. After this is done, the suction and discharge lines with their accompanying mufflers are pressed in from the outside and welded or brazed in place.

The resulting compressor is highly efficient because of the inverted arrangement of the connecting rod, large suction and discharge mufflers, and open porting to ensure high volumetric efficiency. Under normal operating conditions, the discharge pressure is about ten times the suction pressure, and this means that the discharge valve cannot open until the gas in the cylinder is compressed to ten times the suction pressure. With a standard connecting rod configuration this means that the discharge valve will not open until the crankshaft rotates to a position about 37° before top center. However, with the inverted connecting rod configuration of this invention the discharge valve will begin to open when the crankshaft has reached only about 46° before top center. With the compressor motor of the usual two pole type with a running speed of about 3450 rpm, this means that the actual time duration for having the discharge valve in the open position will be increased from about 1.7 milliseconds to about 2.15 milliseconds. This insures more complete emptying of the cylinder space and a reduced amount of reexpansion gas.

While the present configuration does produce a slight increase in friction as a result of the sliding guide portion, the bearing diameters of the connecting rod and the crankshaft remain about the same as the conventional arrangement, and therefore the overall friction losses are only slightly increased. Furthermore, the heat from the motor portion is conducted directly to the casing, as is the heat in the cylinder block, to ensure good heat dissipation. While no lubricating arrangement has been shown, it should be understood that the compressor is intended to operate with the crankshaft in the vertical position, and a suitable oil pump can be provided on the lower end of the crankshaft to operate as usual by centrifugal force by its emersion into a suitable oil reservoir which will lie within the lower cap 13 below the lower face 19 of cylinder block 15.

Although the preferred embodiment of this invention has been shown and described, it should be understood that various modifications and rearrangements of parts may be resorted to without departing from the scope of the invention as defined in the claims.

What is claimed is:

1. A refrigeration compressor comprising a cylinder block having a central opening defining an axis and having first and second sides, a pumping cylinder extending through one side of said cylinder block at right angles to said axis, a guide cylinder extending through said second side of said cylinder block coaxial with said pumping cylinder, an electric motor fixed with respect to said cylinder block and having a rotatable crankshaft extending through said opening along said axis, a piston slidably mounted on said cylinder block, said piston having a first end in said pumping cylinder and a second end in said guide cylinder, said piston having a center section interconnecting said first and second ends, said center section defining a clearance opening surrounding said crankshaft, an eccentric crank on said crankshaft in said clearance opening, a wrist pin in said piston second end, and a connecting rod drivingly connecting said eccentric crank and said wrist pin.

2. A refrigeration compressor as set forth in claim 1, wherein said pumping cylinder and said guide cylinder are of the same diameter.

3. A refrigeration compressor as set forth in claim 1, wherein said piston center section comprises a yoke having a leg on each side of said clearance opening, each of said legs extending between said first and second ends.

4. A refrigeration compressor as set forth in claim 3, wherein said guide cylinder includes longitudinal clearance slots for receiving said legs.

5. A refrigeration compressor as set forth in claim 1, wherein said wrist pin is smaller in diameter than said eccentric crank.

6. A hermetic refrigeration compressor having a casing with a cylindrical wall defining an axis, a cylinder block fitted within and supported by said wall, said cylinder block having a cylinder bore extending perpendicular to said axis and having an open end adjacent said cylindrical wall, said cylinder block having a planar end face around said open end, said end face and the inner surface of said cylindrical wall defining a segmental space, a cylinder head in said segmental space extending over said open end adjacent said end face, said cylinder head having suction and discharge ports extending therethrough in communication with said cylinder bore, said cylinder head having a cylindrical outer surface in abutting sealing engagement with said cylindrical wall inner surface, said cylinder head having a suction space in communication with said suction port, said cylinder head having a portion extending into sealing engagement with said cylindrical wall inner surface and defining a discharge space in communication with said discharge port, a suction line extending from the exterior of said casing through said wall to communicate with said suction space, and a discharge line extending from the exterior of said casing to communicate with said discharge space.

7. A hermetic refrigeration compressor as set forth in claim 6, including a suction muffler in said suction line exterior of said casing.

8. A hermetic refrigeration compressor as set forth in claim 6, including a discharge muffler in said discharge line exterior of said casing.

9. A hermetic refrigeration compressor as set forth in claim 6, wherein said casing includes an end cap fitted within said cylindrical wall and having an edge engaging of side of said cylinder block and said cylinder head.

10. A hermetic refrigeration compressor as set forth in claim 6, including a bearing bore in said cylinder block, a crankshaft journalled in said bearing bore and extending along said axis.

11. A hermetic refrigeration compressor as set forth in claim 10, including an electric motor having a rotor secured on said crankshaft and a stator fitted in and secured to said cylindrical wall.

12. A hermetic refrigeration compressor as set forth in claim 11, wherein said cylinder block has a second bearing bore journalling said crankshaft.

13. A hermetic refrigeration compressor as set forth in claim 12, wherein said second bearing bore is spaced from said first bearing bore and is on the opposite side of said cylinder bore.

14. A hermetic refrigeration compressor comprising a casing having a longitudinally extending wall portion, a cylinder block secured within said wall portion and defining a longitudinal axis, a crankshaft journalled in said cylinder block, electric motor means to rotate said crankshaft, a cylinder bore extending radially from said crankshaft in said cylinder block and defining a cylinder axis, said cylinder bore terminating outwardly in an end face spaced from said wall portion, a cylinder head secured to said cylinder block at said end face and making sealing engagement with the adjacent casing wall portion, a piston mounted in said cylinder bore for movement by said crankshaft to and from said cylinder head, a suction valve reed mounted between said cylinder head and said end face, said cylinder head having a centrally located discharge space and an annular suction space surrounding said discharge space and separated therefrom by a wall, a discharge valve in said discharge space, a suction line extending through said wall portion into said suction space, and a discharge line extending through said wall portion into said discharge space.

15. A hermetic refrigeration compressor as set forth in claim 14, wherein said suction space is defined by walls on said cylinder head and said casing wall portion.

16. A hermetic refrigeration compressor as set forth in claim 15, including a liner extending over at least some of said walls.

17. A hermetic refrigeration compressor as set forth in claim 16, wherein said liner covers the walls defining said suction space on said cylinder head.

18. A hermetic refrigeration compressor as set forth in claim 17, including a suction port extending through said liner and said cylinder head from said suction space to said suction valve reed.

19. A hermetic refrigeration compressor comprising a casing, a cylinder block within said casing, said cylinder block defining a cylinder bore having an axis and terminating at one end in an end face on said cylinder block extending normal to said axis, a piston mounted in said cylinder bore for movement to and from said end face, a crankshaft mounted on said cylinder block and operable through a connecting rod to reciprocate said piston, electric motor means to rotatably drive said crankshaft, a cylinder head secured to said cylinder block and having a valve face extending over said end face, a valve sheet secured between said valve face and said end face, said cylinder head defining a centrally located discharge space and an annular suction space surrounding said discharge space, said cylinder head having a discharge port extending between said valve face and said discharge space adjacent said axis, a discharge valve in said discharge space arranged to be biased against and seal said discharge port, a plurality of suction ports extending from said suction space through said cylinder head and opening on said valve face, said valve sheet being formed to have an annular suction valve portion extending over said suction ports, said annular portion having a central opening in alignment with said discharge port and being integrally connected to the remainder of said valve sheet at a connecting neck which flexes when said annular portion moves to and from said suction ports.

20. A hermetic refrigeration compressor as set forth in claim 19, wherein said suction ports are arranged equidistantly in a circular pattern.

21. A hermetic refrigeration compressor as set forth in claim 19, wherein said suction valve portion and said neck are defined by a slot having a circular portion around said valve portion connected at each end to parallel portions defining said neck.

22. A hermetic refrigeration compressor as set forth in claim 20, wherein said suction ports extend at an angle to said axis and converge toward said valve sheet.

23. A hermetic refrigeration compressor as set forth in claim 22, including an insulating plastic liner in said suction space extending over the surface of said suction space and having openings in alignment with said suction ports.

24. A refrigeration compressor comprising a cylinder block, a crankshaft journalled in said cylinder block, electric motor means to rotate said crankshaft, a cylinder bore extending radially from said crankshaft in said cylinder block and defining a cylinder axis, said cylinder bore terminating outwardly in an end face spaced from a wall portion a cylinder head secured to said cylinder block at said end face and making sealing engagement with an adjacent casing wall portion a piston mounted in said cylinder bore for movement by said crankshaft to and from said cylinder head, a suction valve reed mounted between said cylinder head and said end face, said cylinder head having a discharge space and a suction space separated from said discharge space by a wall, said cylinder head having a suction port connecting said suction space and said cylinder bore, said cylinder head having a discharge port connecting said discharge space and said cylinder bore, said discharge port having a valve seat in said discharge space, a movable poppet making sealing engagement with said valve seat, said poppet forming a face on the side away from said valve seat, a valve spring of flat spring material bent to have a bight portion in engagement with said poppet face, said valve spring having a projecting end on each side of said bight portion, each of said ends being fixed against movement on said cylinder head.

25. A refrigeration compressor as set forth in claim 24, wherein said poppet face is flat and said valve spring bight engages the center of said face.

26. A refrigeration compressor as set forth in claim 24, wherein said discharge space is generally circular with an annular groove receiving said valve spring projecting ends.

* * * * *